US005605250A

United States Patent [19]

Meiron et al.

[11] Patent Number: 5,605,250

[45] Date of Patent: Feb. 25, 1997

[54] STORAGE DEVICE FOR TOILET PAPER ROLLS

[76] Inventors: Sergio G. Meiron, 870 S. Crenshaw Blvd. #101, Los Angeles, Calif. 90005; Josef Nahum, 5738 Katherine Ave., Van Nuys, Calif. 91401

[21] Appl. No.: 249,364

[22] Filed: May 27, 1994

[51] Int. Cl.[6] ..... B65H 1/00

[52] U.S. Cl. ..... 221/32; 242/594.5

[58] Field of Search ..... 221/33; 242/603, 242/590, 598, 599.1, 599.2, 594, 594.5, 594.6

[56] References Cited

U.S. PATENT DOCUMENTS 2,969,169 1/1961 Botnick ..... 242/594.5

4,834,316 5/1989 DeLorean ..... 242/594.5

FOREIGN PATENT DOCUMENTS 2215303 9/1989 United Kingdom ..... 242/594.5

*Primary Examiner*—Kenneth Noland

*Attorney, Agent, or Firm*—Erik M. Arnhem

[57] ABSTRACT

A storage device for unused rolls of toilet paper includes two or more circular tubes arranged in a vertical row below a conventional wall-mounted toilet paper dispenser. The circular tubes are encased within a fabric covering that ties the tubes together. A U-shaped arm structure extends from the uppermost tube to suspend the storage device from the toilet paper dispenser; C-shaped hooks loop over the paper dispenser spindle for suspension purposes.

4 Claims, 1 Drawing Sheet

STORAGE DEVICE FOR TOILET PAPER ROLLS

BACKGROUND OF THE INVENTION

1. Field of The Invention

This invention relates to a device for storing two or more rolls of toilet paper in the space below a wall-mounted toilet paper dispenser. The dispenser is of conventional construction.

2. Prior Developments

Toilet paper is usually supplied in roll form wound around a cardboard tubular mandrel. The homeowner mounts the roll of toilet paper on a dispenser that usually takes the form of a collapsible spindle extending between two support arms mounted on the bathroom wall. When it becomes necessary to use the toilet paper the leading edge of the paper is pulled to unwind a selected length of paper from the roll.

Periodically, it becomes necessary to replace the depleted toilet paper roll with a new roll. The spindle is axially compressed to remove the spindle from the support arms, after which a new roll of toilet paper is placed on the spindle; the spindle (with the new toilet roll of toilet paper positioned thereon) is reinserted into the space between the support arms, such that the new roll of toilet paper is operatively positioned for dispensing selected lengths of paper, as may be needed from time to time.

Under conventional practice, replacement rolls of toilet paper are stored in the bathroom cabinet or in a linen closet located near the bathroom. When it becomes necessary to replace a depleted roll of paper with a new roll, there may be a problem, due to the fact that the new roll may not be readily accessible; the person may not be able to easily reach the new roll of paper.

A further problem relates to the fact that the replacement roll of toilet paper is stored in a concealed space within a cabinet or closet, such that the person tends to forget to buy new toilet paper rolls for use when needed. Also, with small bathroom cabinets, there may be a storage space problem; it may be difficult to find space in the cabinet for storing replacement rolls of toilet paper.

SUMMARY OF THE INVENTION

The present invention relates to a device for storing replacement rolls of toilet paper directly below a conventional wall-mounted toilet paper. The storage device is designed to support the replacement rolls in near proximity to the toilet paper dispenser, such that the person can replace a worn roll of toilet paper with a new roll, while remaining seated on the toilet seat. The person does not have to leave the toilet seat to find a new roll of toilet paper.

A further advantage of the new storage device is that the device uses wall space that is normally vacant, and otherwise not used for a utilitarian purpose. The replacement rolls are stored without using bathroom cabinet space that can be used for other purposes, e.g. storing towels, soap, cleaning utensils, etc.

A further advantage of the new storage device is that the replacement rolls of toilet paper are at least partially visible, such that the person becomes aware of the need for purchasing replacement rolls of paper, i.e. when the storage device is empty. The problem of running out of toilet paper becomes less of a problem.

A preferred embodiment of the invention comprises two rigid circular tubes located one above another within a fabric covering. A U-shaped suspension means is attached to one of the rigid tubes for suspending the tubes from the spindle of a conventional wall-mounted toilet paper dispenser. The suspension means comprises two upwardly-extending arms having curved end portions adapted to hook over the spindle, whereby the rigid storage tubes are suspended below the spindle.

The suspension arms are relatively thin so that the storage device can be installed on the conventional wall-mounted toilet paper dispenser without adversely affecting the operability or usefulness of the dispenser. Each rigid tube is adapted to store one unused roll of toilet paper. In a typical arrangement there are two rigid storage tubes, one arranged above the other, whereby the storage device is capable of storing two unused rolls of toilet paper.

IN THE DRAWINGS

FIG. 1 is a transverse sectional view taken through a storage device constructed according to the invention. FIG. 1 is taken on line 1—1 in FIG. 2. FIG. 1 shows the storage device in a suspended position directly below a conventional wall-mounted toilet paper dispenser.

FIG. 2 is a front view of the assembly depicted in FIG. 1.

DESCRIPTION OF A PREFERRED EMBODIMENT OF THE INVENTION

Figure 1:
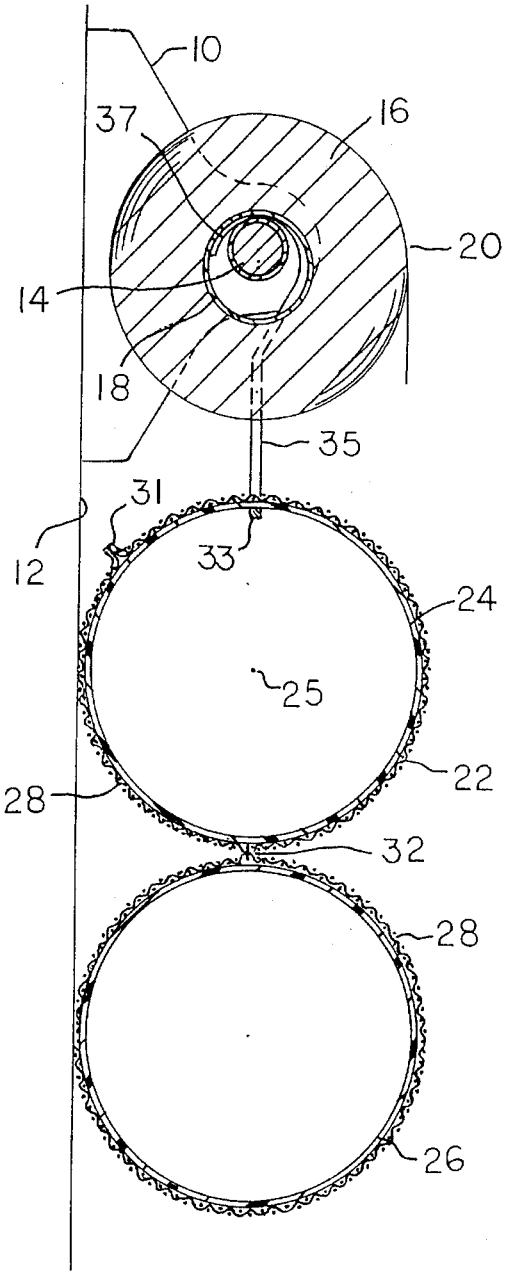

The drawings show a conventional toilet paper dispenser that comprises two support arms 10 projecting from a bathroom wall 12 for supporting a spindle 14. The spindle ends extend into sockets (or recesses) in support arms 10, whereby the spindle is enabled to support a roll of tissue paper 16.

Roll 16 is of a conventional nature, comprising a tubular cardboard mandrel 18, and an elongated strip of paper 20 wound in spiral fashion around the mandrel. The roll of paper is perforated at spaced points along its length, whereby when a length of paper is wound off the roll the paper can be torn at one of the perforations for use of the severed paper strip in the conventional manner.

Spindle 18 comprises two telescopic spindle elements that are spring biased to normally seat in the sockets in support arms 10. The spindle elements can be collapsed axially to facilitate removal of the spindle, e.g. when it becomes necessary to place a new roll of paper in the spindle.

The invention is concerned more particularly with a storage device 22 for storing two or more new (unused) rolls of tissue paper in the space directly below the paper roll 16. The new rolls of toilet paper are thus readily available for placement on spindle 14 when it becomes necessary to replace a depleted roll with a new roll.

Storage device 22 comprises two rigid circular tubes 24 and 26 positioned one above the other within a fabric covering 28. Each tube can be formed of rigid plastic material. The fabric covering acts as a means for securing tubes 24 and 26 together. The fabric covering also acts as a decorative screen over the tubes. Various patterns, color combinations, and scenes can be printed on the fabric covering for ornamentation purposes.

The two rigid tubes 24 and 26 have internal diameters that are slightly larger than the diameter of an unused roll of toilet paper, whereby one new roll of paper can be placed in each tube. The ends of each tube are open so that the paper rolls can be easily inserted into the tubes or drawn out of the tubes, as desired.

Figure 2:
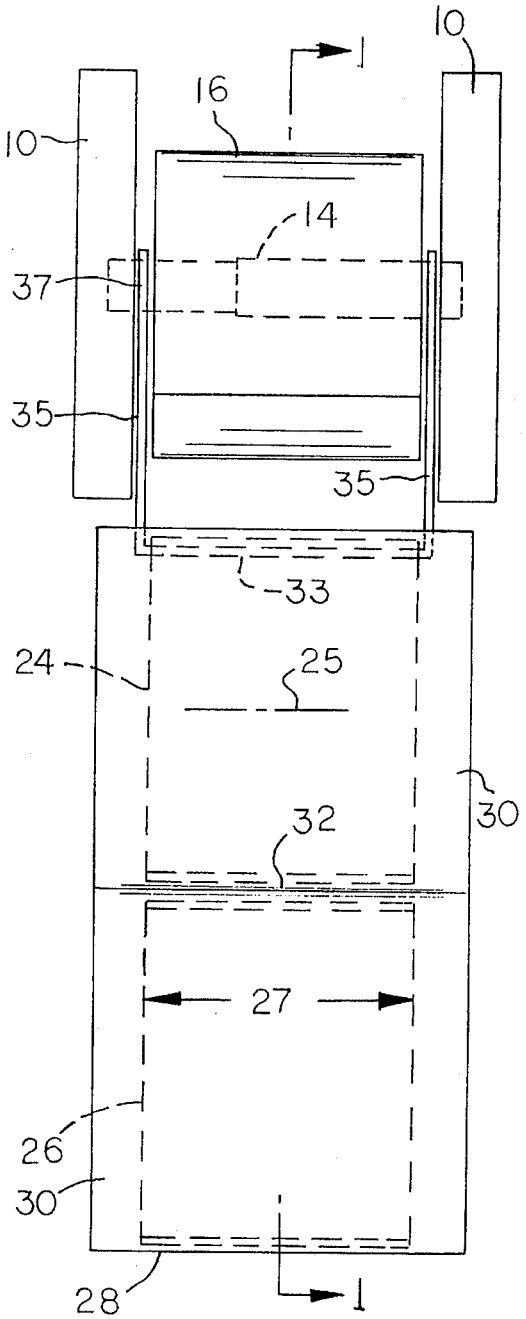

As shown in FIG. 2, each tube 24 or 26 has an axial length dimension 27 that is the same as the length of a conventional roll of toilet paper, such that each tube fully contains a roll of toilet paper. End portions 30 of the fabric covering 28 extend beyond the ends of the tubes 24 and 26 so as to partially obscure the rolls of toilet paper stored in the tubes.

The end portions 30 of the fabric covering can be pleated to form ornamental ruffles,if so desired. Also, ornamental beading or edging can be provided on the fabric end portions 30 for decoration purposes.

Fabric covering 28 comprises a single fabric sheet having a length that is slightly Greater than twice the circumference of tube 24 and 26. The ends of the fabric sheet are stitched together, as at 31 in FIG. 1. Also, facing areas of the fabric sheet are stitched together, as at 32, so that the fabric sheet forms two fabric sleeves. Each fabric sleeve is slipped over one of the rigid tubes 24 or 26, such that the fabric sheet secures the tubes together, as shown in FIG. 1.

The drawings show a storage device comprising two rigid tubes 24 and 26. The capacity of the device can be increased by adding a third tube below tube 26. The fabric covering 28 would, of course, have to be lengthened to accomodate the third tube.

The tube assembly is suspended from the toilet roll dispenser by a U-shaped suspension means that comprises a rod (or rigid bar) 33 extending within tube 24 so as to be seated against the interior roof surface of the tube; rod 33 can be adhesively attached to the interior surface of tube 24.

The suspension means further comprises two arms 35 extending upwardly from opposite ends of rod 33 normal to the tube axis 25. The upper end of each arm 35 is curved into a C-configuration, designated by numeral 37 in FIG. 1. Preferably the rod 33 and arms 35 are formed out of a single length of bar stock having a square cross section. The bar can be plastic or metal.

Each C-shaped section 35 forms a hook circumscribing a space somewhat larger than the diameter of spindle 14, whereby the hooks can be readily looped over the spindle to suspend the storage device directly below the toilet paper dispenser.

When it becomes necessary to replace a depleted roll of paper with a new roll, a new unused roll is removed from one of tubes 24 or 26. The storage device is temporarily removed from its suspended position while the new roll is being installed in the dispenser. Afterward, the storage device is moved back to the position depicted in FIG. 1.

The storage device does not interfere with normal usage of the dispenser. Paper roll 16 can be rotated on spindle 14, for severing paper sections from the roll, in the conventional fashion. The U-shaped suspension means 33, 35 has a relatively small cross sectional dimension so that C-shaped hooks 37 can be inserted onto spindle 14 without difficulty.

The storage device is relatively unobtrusive, while at the same time offering the convenience and accessibility required for quick replacement of used toilet paper rolls with new unused rolls.

What is claimed is:

1. A storage device for toilet paper rolls comprising:

two horizontal rigid circular tubes having open ends; said tubes having the same diameter and same axial length;

said tubes being arranged with their axies parallel and their ends aligned in common planes;

each tube having a diameter slightly greater than the diameter of the toilet paper roll, whereby each tube is enabled to store one toilet paper roll;

means securing said tubes together; and a U-shaped means for suspending said tubes from the spindle of a wall-mounted toilet paper roll dispenser;

said U-shaped tube-suspending means comprising a rod extending within one of said tubes so as to be seated against the interior roof surface of said one tube to bear the tube weight, and two hooks integral with said rod; said hooks extending upwardly from said rod at opposite ends of said one tube so as to be normal to the tube axis; said hooks being similarly constructed;

Each hook comprising a curved end portion adapted to partially encircle the spindle of a wall-mounted toilet paper roll dispenser, whereby said tubes are suspended directly below the dispenser; the curved end portions of each hook curcumscribing a space greater than the spindle diameter whereby said hooks can be lifted from the spindle to remove said tubes from the space below the dispenser.

2. The storage device of claim 1, wherein said means for securing the tubes together comprises a fabric covering extending along and around said tubes;

said fabric covering comprising a fabric sheet having spaced areas thereof stitched together to define two connected fabric sleeves;

each fabric sleeve having a friction fit on one of said tubes.

3. The storage device of claim 2, wherein each fabric sleeve has a length greater than the length of the associated tube, whereby the end portions of the fabric sleeves partially conceal toilet paper rolls stored within the rigid tubes.

4. A storage device for multiple toilet paper rolls, comprising:

two rigid circular tubes having open ends; same tubes having the said diameter and the same axial length; said tubes being arranged with their axes parallel and their open ends aligned in common planes;

each tube having a diameter slightly greater than the diameter of a toilet paper roll, whereby each tube is enabled to store one toilet paper roll;

means securing said tubes together so that the tube axes are parallel; and a U-shaped means for suspending said tubes from the spindle of a wall-mounted toilet paper roll unwinder mechanism;

said U-shaped tube suspending means comprising a rod extending within one of said tubes so as to be seated against the interior roof surface of said one tube; said rod having opposite ends located alongside the open ends of said one tube; and hooks extending from the opposite ends of said rod in planes normal to the tube axis;

said hooks being similarly constructed; each hook comprising a curved end portion adapted to be looped over the spindle of a wall-mounted toilet paper unwinder mechanism, whereby said tubes are suspended directly below the unwinder mechanism;

the curved end portion of each hook circumscribing a space greater than the spindle diameter, whereby said hooks can be lifted from the spindle to remove said tubes from the space below the unwinder mechanism;

said means for securing the tubes together comprising a fabric covering extending along and around said tubes; said fabric covering comprising a fabric sheet having spaced areas thereof stitched together to define two connected fabric sleeves; each fabric sleeve having a friction fit on an associated rigid tube;

each fabric sleeve having an axial length greater than the length of the associated tube, whereby the end portions of the fabric sleeves extend beyond the ends of the tubes to partially conceal the toilet paper rolls stored within the rigid tubes.

* * * * *